US006742296B2

(12) United States Patent
Johnson et al.

(10) Patent No.: US 6,742,296 B2
(45) **Date of Patent: *Jun. 1, 2004**

(54) SYSTEM FOR MOUNTING FRONT-LOADED PHOTOGRAPHS

(75) Inventors: Thomas A. Johnson, Sandy Hook, CT (US); Scott Larsen, Newtown, CT (US)

(73) Assignee: Wet Puppy Products, LLC, Sandy Hook, CT (US)

( * ) Notice: Subject to any disclaimer, the term of this patent is extended or adjusted under 35 U.S.C. 154(b) by 91 days.

This patent is subject to a terminal disclaimer.

(21) Appl. No.: 10/140,858

(22) Filed: May 7, 2002

(65) Prior Publication Data

US 2002/0162263 A1 Nov. 7, 2002

Related U.S. Application Data

(63) Continuation-in-part of application No. 09/655,650, filed on Sep. 5, 2000, now Pat. No. 6,519,886.

(51) Int. Cl.[7] ..... A47G 1/06
(52) U.S. Cl. ..... 40/790
(58) Field of Search ..... 40/718, 739, 740, 40/790, 792, 156

(56) References Cited

U.S. PATENT DOCUMENTS 565,778 A * 8/1896 Murphy ..... 40/324
765,873 A * 7/1904 Berry ..... 40/792
1,358,988 A * 11/1920 Rindsberger ..... 40/790
1,400,920 A * 12/1921 Stroud ..... 40/790
1,600,658 A * 9/1926 Weil ..... 40/324
1,836,035 A * 12/1931 Matys ..... 40/735
3,220,132 A * 11/1965 Swiger et al. ..... 40/711
3,408,759 A * 11/1968 Rotheraine et al. ..... 40/732
3,445,151 A * 5/1969 Stefanakis ..... 359/514
3,557,478 A * 1/1971 Sitzberger ..... 40/1.5
4,399,910 A * 8/1983 Gutentag ..... 206/82
4,553,344 A * 11/1985 Rubin et al. ..... 40/152
4,561,200 A * 12/1985 Hehn ..... 40/156
4,939,858 A * 7/1990 Dailey ..... 40/152.1
4,996,784 A * 3/1991 Hsu ..... 40/152
5,012,601 A * 5/1991 Garland et al. ..... 40/152
5,125,175 A * 6/1992 Huff, Jr. ..... 40/718
5,659,990 A * 8/1997 Henneman et al. ..... 40/795
5,974,714 A * 11/1999 Jones ..... 40/768
6,263,604 B1 * 7/2001 Williams ..... 40/718
6,467,210 B1 * 10/2002 Chang ..... 40/792
6,519,886 B1 * 2/2003 Johnson et al. ..... 40/790
2002/0078613 A1 * 6/2002 Roberts et al. ..... 40/800
2003/0046849 A1 * 3/2003 Lin ..... 40/792

* cited by examiner

*Primary Examiner*—William L. Miller
(74) *Attorney, Agent, or Firm*—McCormick, Paulding & Huber LLP

(57) ABSTRACT

System for mounting a thin flat object such as a photograph into a curvilinear recess formed in the front of a substrate, using a curvilinear decorative flexible retaining ring. The retaining ring is retained either by interference or frictional engagement with a smooth sidewall portion of the recess wall. Optionally, a transparent protective cover may be included.

8 Claims, 8 Drawing Sheets

SYSTEM FOR MOUNTING FRONT-LOADED PHOTOGRAPHS

CROSS REFERENCE TO RELATED APPLICATIONS

Figure 1:
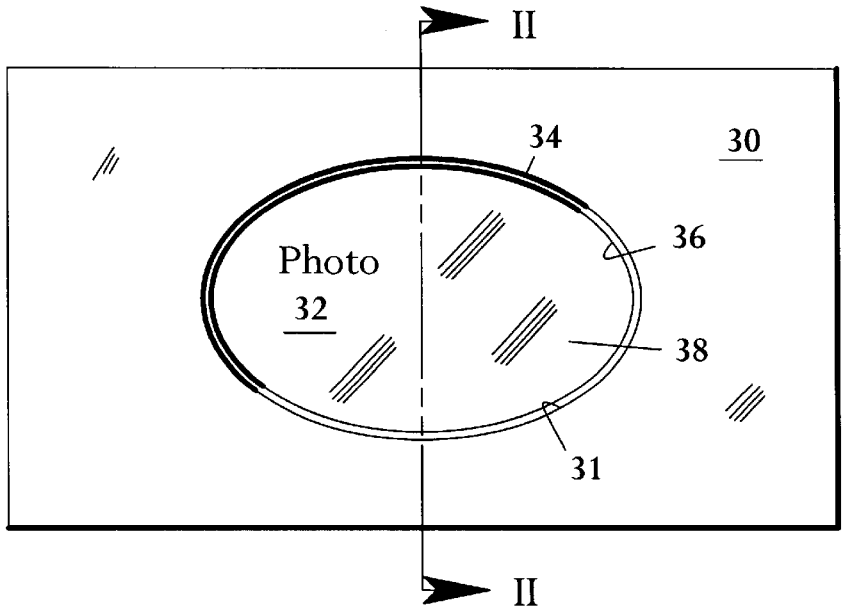

This is a continuation-in-part of pending patent application Ser. No. 09/655,650 filed Sep. 5, 2000 now U.S. Pat. No. 6,519,886, in the names of Thomas A. Johnson and Scott Larsen and assigned to the present assignee.

This invention relates to a system for mounting photographs and the like, and more particularly to a system for mounting front-loaded photographs or other thin flat items into recesses in the surface of a piece of wood or other solid substrate.

BACKGROUND OF THE INVENTION

Often it is desirable to mount and display thin, flat items such as photographs, artwork, stamps, needlepoint, baseball cards or labels. Display frames are traditionally made by joining a number of side members together with glue, nails, chevrons or other fastening devices. It is time consuming to make frames by this method, since the side members must first be formed, and then assembled. A number of costly tools are required to produce professional results. Most traditional frames are square or rectangular, the comers being mitered to disguise the cut end portions of the side members. In industry, expensive and precise machines are used to cut and join the mitered side pieces due to the accuracy required to make all four comer joints meet at the proper angle without gaps. For woodworkers and hobbyists without such machinery, making display frames in this manner can be frustrating.

Another disadvantage of traditionally-made display frames is the difficulty of making frames with curved or free-form perimeters. Shaping, forming, and joining separate pieces to produce such profiles is extraordinarily difficult. Similarly, making frames with single or multiple display openings in the shape of circles, ovals, hearts, or other non-rectangular forms is also challenging.

The solution to creating free-form display frames from wood is usually to machine the desired perimeter from a solid slab of wood, and then cut holes through the slab in the shape of the desired display openings. The slab is then turned over, and in a separate machining operation a rabbet is formed from the back side of the frame to allow the glass, display item, and backing members to be assembled in the traditional way. Having to re-fixture the frame and conduct the rabbeting operation is time consuming, adding significantly to the labor component of the frame-making process.

To address the issue of creating different shapes and/or numerous display frame openings, traditional display frames commonly employ decorative mats that surround the framed item or items. These mats can improve the appearance of a framed item by allowing it to be cropped to eliminate unwanted or distracting elements. In most ready-made commercial frames, however, this advantage is mitigated by the fact that the mat openings are made to a specific size and shape, with no relationship to the item that may ultimately appear behind it. These mats provide no means of altering their size, shape, or arrangement, a frustration to people interested in exercising creativity in the framing process. The most common current solution to this problem is to have items professionally framed with custom-made mats. Another solution is to purchase mat cutting equipment to provide the desired flexibility. Both of these expensive solutions are beyond the means of many millions of consumers.

In addition to mats, traditional display frames frequently employ a backing piece of wood or cardboard that is separate from the main frame. This backing piece covers and presses against the rear side of the item being framed, protecting it from dust and moisture and helping to retain the item and protective glass or plastic within the main frame. Fasteners are usually required to hold the backing piece in place. Accurately placing and driving these fasteners requires the use of tools, and can be difficult. The necessity of removing the fasteners to change the contents of the display frame is time consuming, and can damage the frame.

Consequently, while there are many systems and techniques for mounting photographs or other thin flat items from the back side of a frame, there are many times when it is desirable to recess and retain the items from the front side of the mounting structure. This is particularly true when the back of the mounting structure is inaccessible or inconvenient to reach. For example, it may be desirable to recess and retain a photograph in a piece of wood of considerable thickness, or into a desktop or installed wall panel where only the front surface is accessible. Being able to change the display item without accessing the back of the frame is a distinct advantage of front-loading frames in these applications.

Another advantage of front-loading frames is that a portion of the main frame can serve the same function as the separate backing piece of a traditional frame, resulting in a reduction in the number of components needed to frame an item, as well as faster and easier assembly and disassembly.

Since most photographs are rectangular, display frames ordinarily provide a rectangular recess to hold them. Because of the difficulty of machining flat-bottomed recesses with square comers, most front-loading display frames where the main frame member is adapted to eliminate a backing piece are made as a single unitary piece by casting, forging, forming, or molding processes. These processes are too costly for do-it-yourself picture framers to utilize.

A number of prior art systems are known for mounting photographs and the like from the front side of a recess or picture frame. These known systems usually require that the recess include a groove in the sidewall, or a flanged retaining frame with the flange overhanging the perimeter of the recess, or rectangular inner frames with square comers which are press fit into the recess. For example, U.S. Pat. No. 1,836,035-Matys shows a front-loaded coin and picture frame, in which coins or photographs are held in a recess by means of an expanding circular spring ring fitting in a groove in the sidewall. There currently exists a round plastic photograph frame insert assembly that holds a photograph in a round recess. It uses a flanged retaining ring design, whereby the flange overhangs the perimeter of the recess, and the photograph is held inside the insert by a separate backing piece that snaps into the insert. This complete assembly is then pressed into the recess. Molded tabs on the perimeter of the insert ring press against the sidewall of the recess to hold it in place.

U.S. Pat. No. 4,939,858 issued Jul. 10, 1990 to Dailey shows (FIG. 3) a rectangular inner clamping frame of plastic which frictionally engages the edges of an outer recess holding a photograph with rectangular dimensions loaded from the front. The inner rectangular clamping frame is dimensioned to be held frictionally in place within a recess with planar sidewalls.

U.S. Pat. No. 3,445,151 issued May 20, 1969 to Stefanakis discloses a front loaded mirror assembly, wherein a recess with a closed bottom surface is provided with ribs spaced from the sidewalls, leaving channels around the periphery. A bezel retaining the mirror in the recess includes legs, which are heat-sealed in the channels.

Other front-loaded frames with mounting members holding a thin flat item within a recess accessible only from the front are disclosed in the following patents, which are exemplary of the prior art.

| U.S. Pat. No. | Issue Date | Inventor |
|---|---|---|
| 5,075,991 | Dec. 31, 1991 | Wenkman et al. |
| 4,750,282 | Jun. 14, 1988 | Zennedjian |
| 4,271,619 | Jun. 9, 1981 | Schmidt |
| 4,030,220 | Jun. 21, 1977 | Kotchen |
| 3,579,886 | May 25, 1971 | Hughes |
| 1,882,157 | Oct. 11, 1932 | Minton |
| 765,873 | Jul. 26, 1904 | Berry |

In light of the foregoing, several objects and advantages of the present invention are:

a.) to provide an improved system for removably mounting photographs or other thin, flat items into the front surface of wood or similar substrate materials;

b.) to provide a system for mounting thin, flat items into the surface of substrates having significant thickness;

c.) to provide a system for making a display frame from a unitary, solid substrate, eliminating the need to join together a plurality of frame members;

d.) to provide a system for mounting front-loaded thin, flat items where the items can be easily removed from the front side of the frame;

e.) to provide a system for making display frames that eliminates the need for a backing piece behind the display item that is separate from the frame;

f.) to provide a system for making front-loading display frames that allows inexpensive, common machining processes such as drilling, milling, or routing to be used to produce the part of the frame that receives the display item, in addition to more expensive, tooling-intensive processes like molding, casting or forging;

g.) to provide a front-loaded display frame mounting structure that can accommodate a variety of shaped display frame openings, all of which can be produced using a single axially-rotatable cutting tool such as a drill, end mill, or router bit, with a single setup in a single machining operation;

h.) to provide an improved front-loading display frame mounting structure utilizing a single element to hold the display item in place that also serves a decorative function;

i.) to provide a display frame that may be readily assembled without the use of tools;

j.) to provide a front-loading display frame having one or more shaped display frame openings that does not require the use of mats;

k.) to provide an improved structure for display frames with free-form perimeters made from solid substrates, eliminating the need for a separate rabbeting operation on the back of the frame to create a recess for receiving the glass, photograph, and backing member.

SUMMARY OF THE INVENTION

The invention comprises a system for mounting thin flat items, comprising a substrate having an outer surface defining at least one recess therein, the recess having an opening thereinto from the outer surface, a closed, planar bottom surface, and a curvilinear recess wall connecting the closed planar bottom surface to the recess opening in the outer surface, the recess wall having a smooth curvilinear sidewall portion intersecting the planar bottom surface, the recess wall defining a continuous curvilinear periphery of the recess having a first peripheral outline, a first peripheral dimension and a second peripheral dimension, whereby the first peripheral outline and first peripheral dimension define the smallest shape and size of the recess, and whereby the first peripheral outline and the second peripheral dimension define the shape and size of the recess at the intersection of the sidewall portion and the planar bottom surface; and a continuous flexible decorative retaining ring, the retaining ring having a curvilinear peripheral outline corresponding to the first peripheral outline and arranged to contact the sidewall portion, the retaining ring being disposed in the recess and having a third peripheral dimension smaller than the first peripheral dimension, so as to retain a thin flat item that has been inserted into the recess opening.

In the preferred embodiment, the second peripheral dimension of the recess is greater than the first peripheral dimension of the recess, whereby the retaining ring is held in place by interference engagement with the sidewall portion of the recess.

In another embodiment, the second peripheral dimension of the recess is substantially equal to the first peripheral dimension of the recess, whereby said retaining ring is held in place by frictional engagement with the sidewall portion of the recess.

The system also optionally includes a transparent protective cover, the cover being disposed in the recess between the display item and the retaining ring so as to rest on top of the item to protect it and to hold it flat against the planar bottom surface of the recess, the cover having a curvilinear periphery substantially the same as the first peripheral outline of the recess but having a slightly smaller peripheral dimension than the first peripheral dimension of the recess, whereby the cover is arranged to fit inside the recess.

In its preferred embodiment the substrate is wood and the retaining ring is plastic. Curvilinear shapes may be circular, elliptical, heart-shaped, or polygonal with filleted comers. The term "curvilinear" is defined herein to include straight lines joined by curved lines, but to exclude straight lines intersecting with each other.

DRAWINGS

Figure 2:
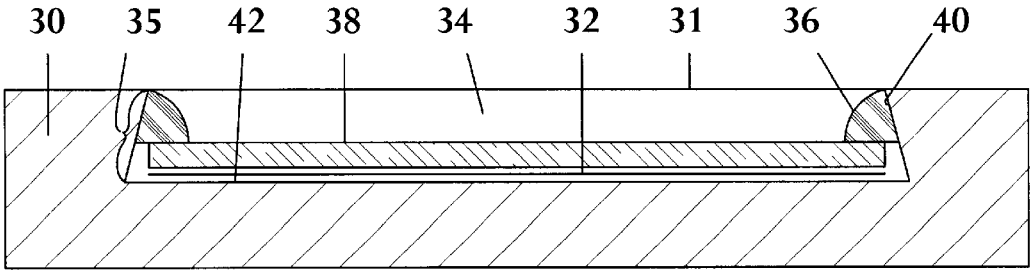
Figure 3:
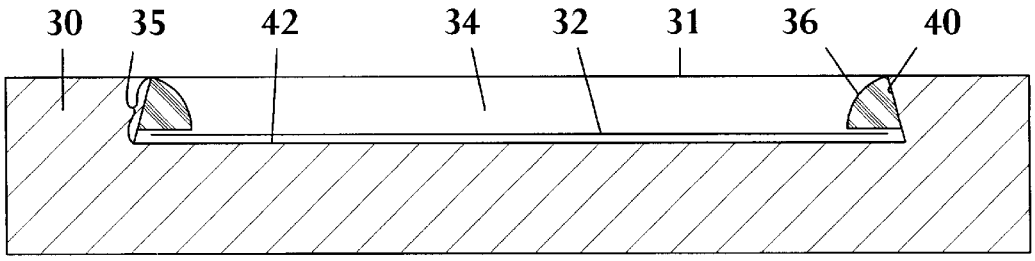
Figure 4A:
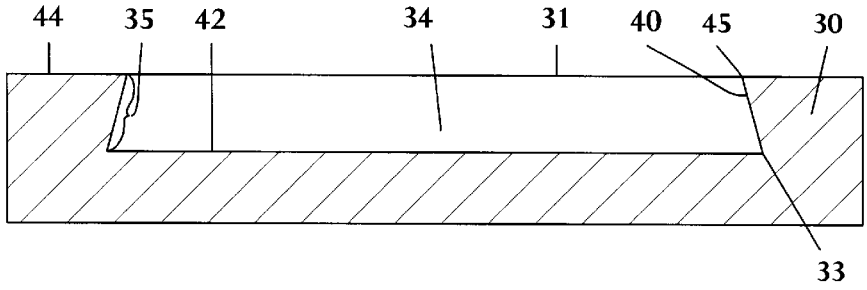
Figure 4B:
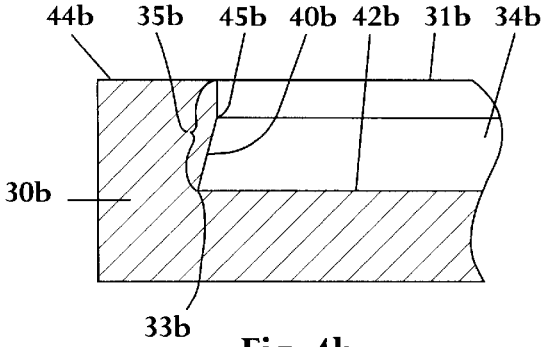
Figure 4C:
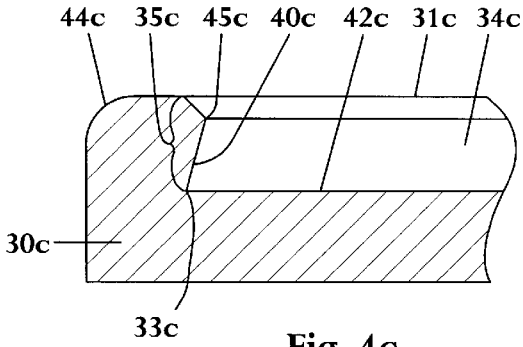
Figure 4D:
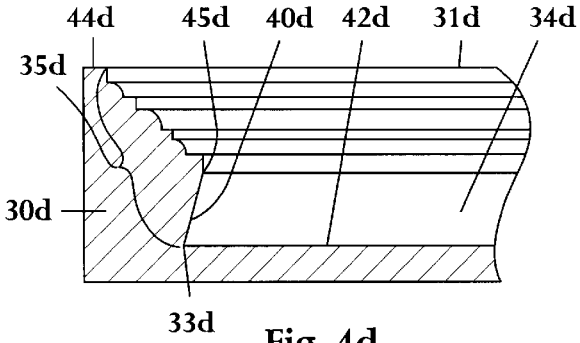
Figure 4E:
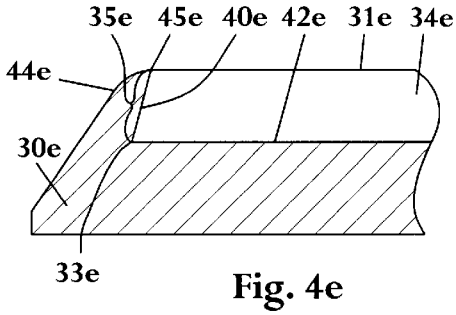
Figure 5:
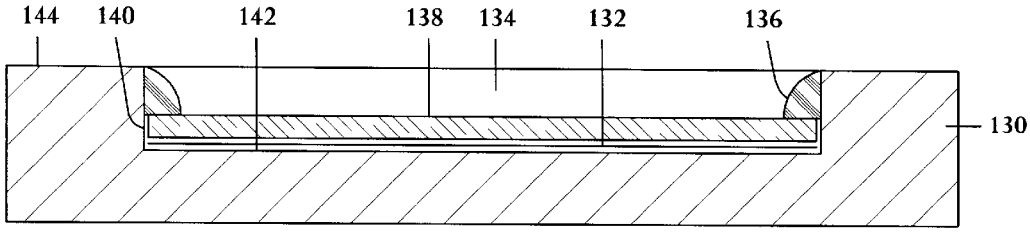
Figure 6:
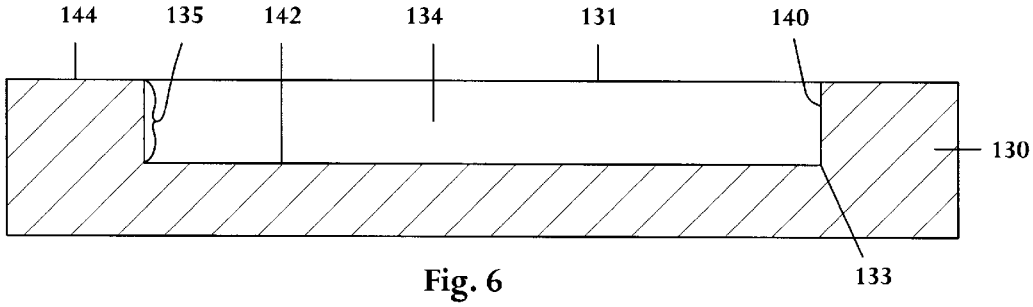
Figure 7:
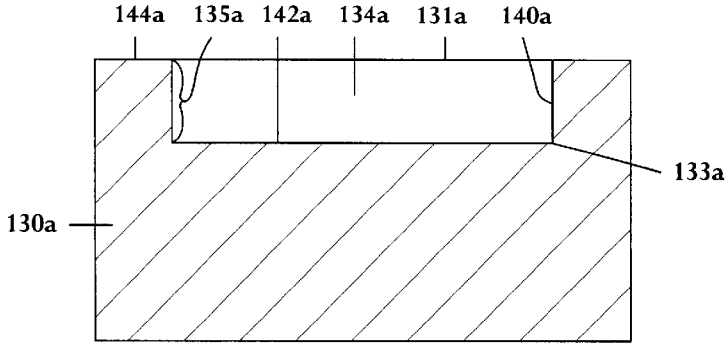
Figure 8:
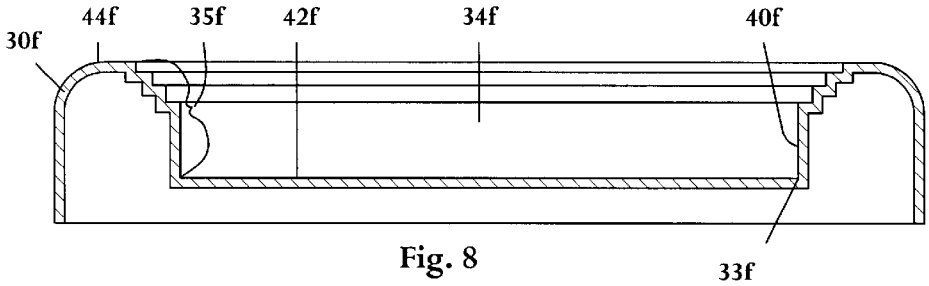

The invention will be more clearly understood by reference to the following description taken in connection with the accompanying drawings, in which:

FIG. 1 is a plan view of a single front-loaded photograph behind a transparent protective cover in a wooden mounting or substrate, FIG. 2 is an end elevational view, in cross section taken along lines II—II of FIG. 1, FIG. 3 is an end elevational view, in cross section similar to FIG. 2, showing the system without the optional transparent cover, FIG. 4*a* is the same cross sectional view as FIG. 2 but without the photograph, transparent protective cover and retaining ring, showing the recess in the substrate, FIGS. 4*b* through 4*e* are the same cross sectional view similar to FIG. 2, but showing a variety of outer surface and recess profiles, FIG. 5 is an end elevational view, in cross section similar to the view taken along lines II—II of FIG. 1 but showing a modified form of the invention, FIG. 6 is the same cross sectional view as FIG. 5 but without the photograph, protective cover and retaining ring, showing the recess in the substrate, FIG. 7 is a cross sectional view similar to that shown in FIG. 6, but showing a substrate having considerable thickness, FIG. 8 shows a cross-sectional view of a molded plastic frame made according to the present invention, FIGS. 9*a* through 9*h* are plan views of a variety of shapes of molded plastic retaining rings to be utilized with matching recesses, FIGS 10*a* through 10*j* are enlarged elevational views, in cross section, taken along lines X—X of FIG. 9, of a variety of molded plastic retaining rings useable for any of the retaining rings depicted in FIGS. 9*a* through 9*h,*

Figure 10A:
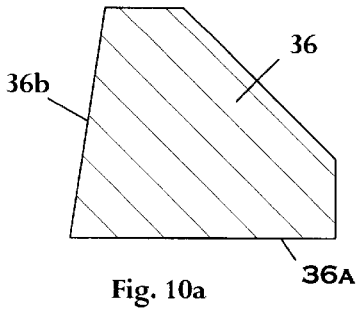
Figure 10B:
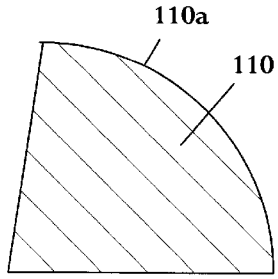
Figure 10C:
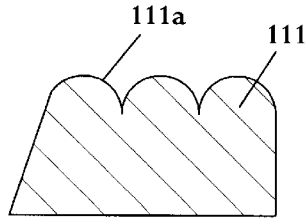
Figure 10D:
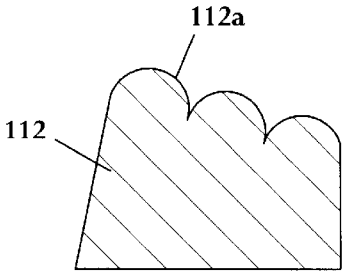
Figure 10E:
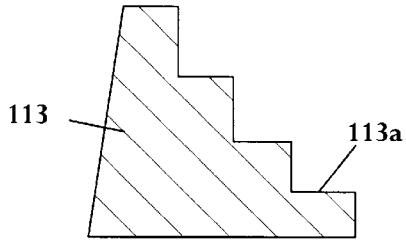
Figure 10F:
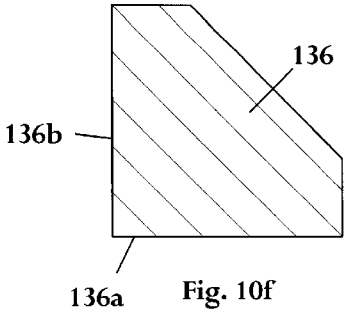
Figure 10G:
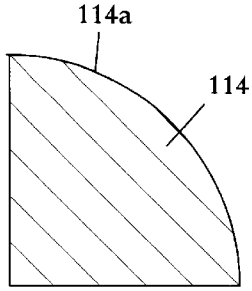
Figure 10H:
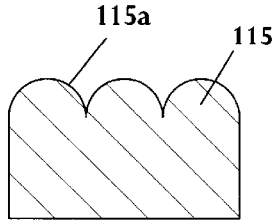
Figure 10I:
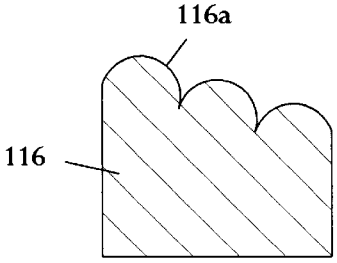
Figure 10J:
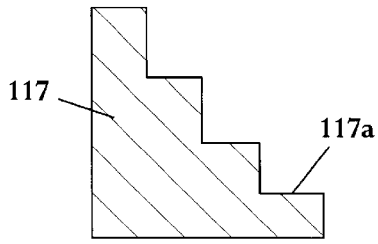
Figure 11:
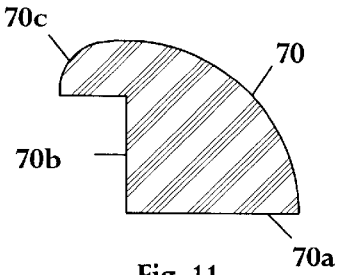
Figure 12:
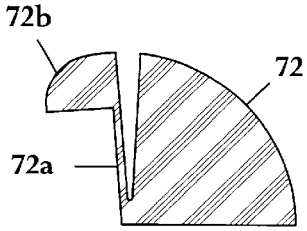
Figure 13:
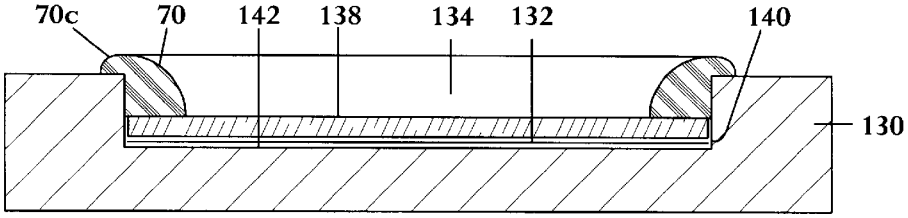
Figure 14:
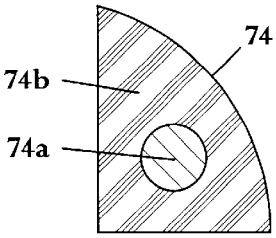
Figure 15:
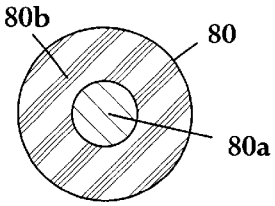
Figure 16:
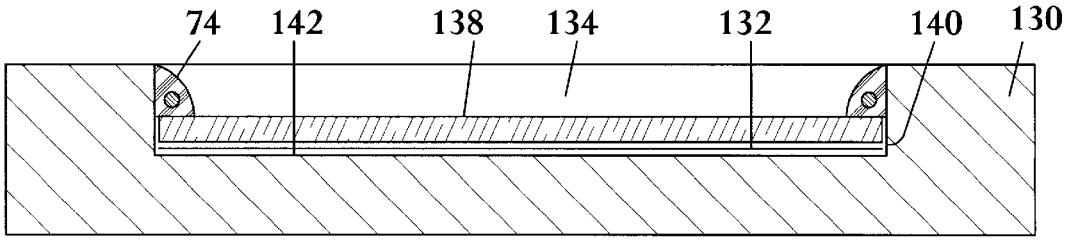
Figure 17:
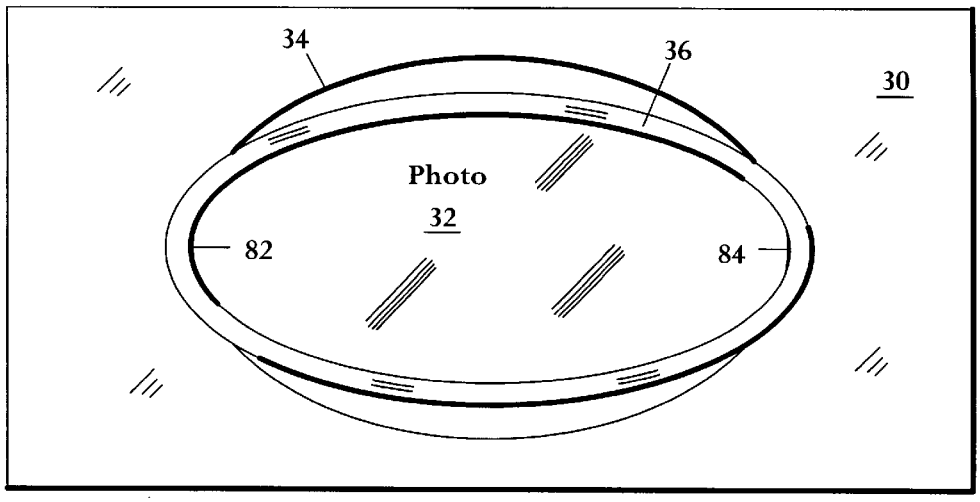
Figure 18:
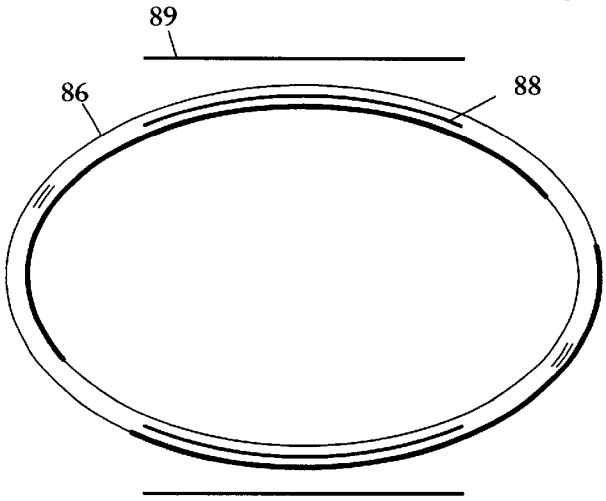
Figure 19:
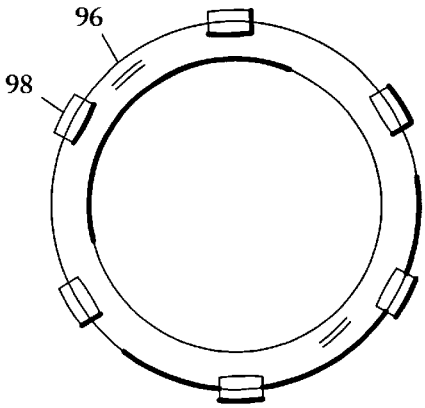
Figure 20:
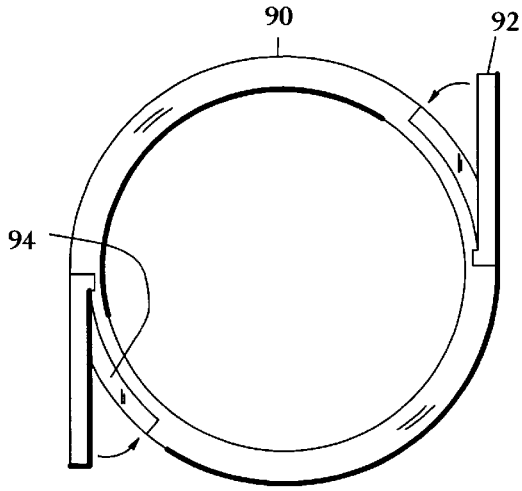
Figure 21A:
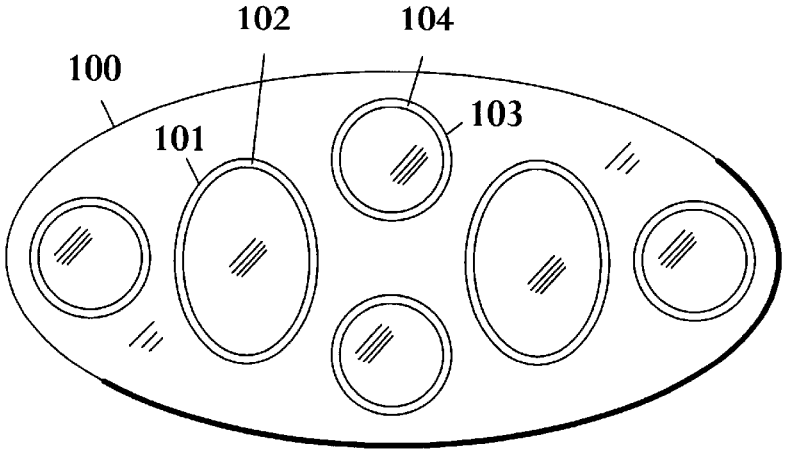
Figure 21B:
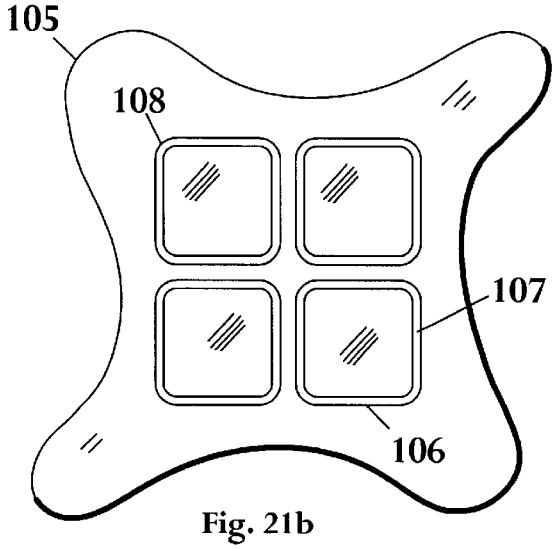
Figure 21C:
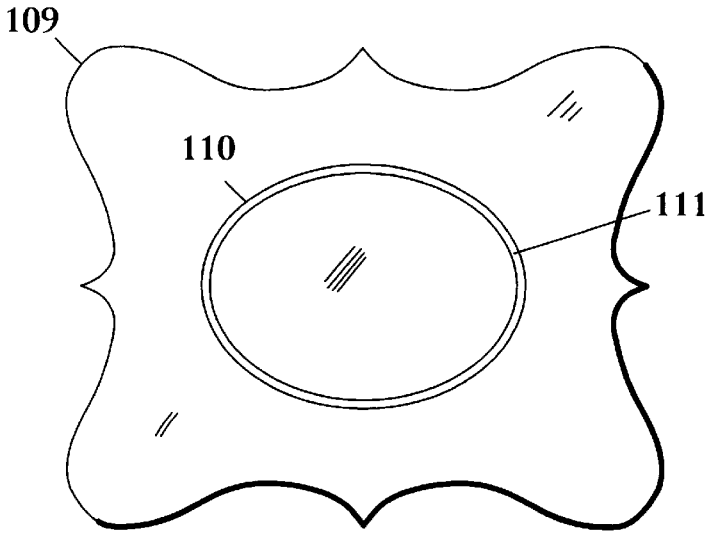

FIGS. 11 and 12 are enlarged cross sectional views similar to FIG. 10 illustrating alternate forms of retaining rings having an external flange, FIG. 13 is an end elevational view, in cross section, of a photograph mounted in a wood substrate using the retaining ring depicted in FIG. 11, FIGS. 14 and 15 are enlarged cross sectional views of composite retaining rings having metal cores, FIG. 16 is an end elevational view of a wood substrate, taken in cross section, utilizing a retaining ring as depicted in FIG. 14, FIG. 17 is a plan view of a substrate with elliptical recess indicating a retaining ring of a slightly different elliptical shape, FIGS. 18 through 20 are bottom plan views of modified plastic retaining rings showing alternate means of providing frictional engagement with the sidewall of the recess, and FIGS. 21*a* through 21*c* are plan views of a variety of display frames with free form perimeters having one or more shaped recess openings made according to the present invention.

DESCRIPTION OF THE PREFERRED EMBODIMENT

Referring to FIG. 1 of the drawing, a wooden substrate 30 serves as a frame for mounting a photo 32 within an elliptical recess 34 having an elliptical opening 31 and a recess wall indicated by brackets 35 (FIG. 4*a*). The photograph and its transparent protective cover 38 are retained in recess 34 by an elliptical retaining ring 36. The wood substrate 30 may be of any thickness greater than the depth of recess 34, since the photograph 32 is mounted from the front. The substrate 30 may include a suitable bracket, stand or hanging cord (not shown) which is not material to the present invention. Substrate 30 may also be part of a larger structure such as a desk top, wall panel, door, trim piece or molding.

Referring to FIG. 2 of the drawing, the cross section shows photograph 32 in the bottom of the recess to be covered by a transparent protective cover 38 of plastic or glass, and held in place by retaining ring 36 making interference engagement with a smooth sidewall portion 40 of recess 34. The smooth sidewall portion 40 is part of the overall recess wall 35. Retaining ring 36 is a continuous ring of flexible molded plastic material having a perimeter arranged to continuously engage the smooth sidewall portion 40 of recess 34. Retaining ring 36 is preferably selected to be of a cross sectional dimension so that the combined height of the flexible retaining ring, protective cover and photograph are less than the height of the recess wall 35.

Reference to FIG. 3 of the drawing illustrates an alternate embodiment of the invention whereby the protective cover is omitted and retaining ring 36 bears directly against photograph 32 to hold it in recess 34.

Reference to FIG. 4*a* of the drawing illustrates the substrate 30 as formed with the recess 34 in accordance with the present invention. Substrate 30 has an outer surface 44 into which recess opening 31 is formed. The recess has a closed planar bottom surface 42. The smooth planar sidewall portion 40 intersects the planar bottom surface at an acute angle at the location indicated by reference number 33. Recess wall 35 encircles the recess to define a continuous curvilinear periphery with a peripheral outline or shape, such as a circle, ellipse, heart shape, or polygon with filleted comers. In contrast to the prior art, the sidewall portion 40 is smooth and devoid of grooves, such as those used to retain prior art "O-ring" or split-ring type retainers.

Reference to FIGS. 4*b* through 4*e* shows a variety of different cross sectional profiles of outer surface 44. FIGS. 4*b* through 4*e* represent cross-sections through substrates of any selected peripheral shape and thickness and are not intended to be confined to the rectangular substrate and elliptical recess opening of FIG. 1. However, in order to more clearly define the inventive concept, they have been given reference numbers which correspond to those shown in FIG. 1.

FIG. 4*b* shows a substrate 30*b* with an outer surface 44*b*, a recess 34*b*, a curvilinear recess wall 35*b* with a smooth curvilinear sidewall portion 40*b* and a closed planar bottom surface 42*b*. The recess 34*b* commences at recess opening 31*b*, with a first peripheral outline and first peripheral dimension of smallest shape and size of the recess denoted by reference number 45*b*. The smooth sidewall portion 40*b* intersects the bottom 42*b* at 33*b* along a peripheral outline corresponding to the first peripheral outline, but having a larger or second peripheral dimension.

Similarly, FIG. 4*c* shows substrate 30*c*, outer surface 44*c*, recess 34*c* with curvilinear recess wall 35*c* extending to the closed planar bottom surface 42*c*. A smooth curvilinear sidewall portion extends from curvilinear first peripheral outline of smallest shape and size of the recess denoted at reference number 45*c* to the intersection with the planar bottom of the recess denoted at reference number 33*c*.

Similarly, FIG. 4*d* shows substrate 30*d*, outer surface 44*d*, recess 34*d* with curvilinear recess wall 35*d* extending to the closed planar bottom surface 42*d*. A smooth curvilinear sidewall portion extends from curvilinear first peripheral outline of smallest shape and size of the recess denoted at reference number 45*d* to the intersection with the planar bottom of the recess denoted at reference number 33*d*.

Similarly, FIG. 4*e* shows substrate 30*e*, outer surface 44*e*, recess 34*e* with curvilinear recess wall 35*e* extending to the closed planar bottom surface 42*e*. A smooth curvilinear sidewall portion extends from curvilinear first peripheral outline of smallest shape and size of the recess denoted at reference number 45*e* to the intersection with the planar bottom of the recess denoted at reference number 33*e*.

FIG. 5 through FIG. 7 show an alternate embodiment of the invention wherein a substrate 130 with a recess wall 135 includes a sidewall portion 140, which intersects planar bottom surface 142 at a right angle. FIG. 5 shows retaining ring 136, protective cover 138, and photograph 132 disposed in recess 134.

FIG. 6 shows the substrate 130 without the retaining ring, protective cover, and photograph. A curvilinear recess opening 131 in outer surface 144 has a recess wall 135 with a smooth curvilinear wall portion 140 intersecting the planar bottom surface 142 at reference number 133 at a right angle.

FIG. 7 shows recess 134*a* formed in substrate 130*a*, where substrate 130*a* is of considerable thickness. Reference numbers 130*a*–144*a* in FIG. 7 correspond to the same respective elements 130–144 of FIG. 6.

FIG. 8 shows another alternate embodiment of the invention wherein substrate 30*f* is molded from plastic, and outer surface 44*f*, recess 34*f*, planar bottom surface 42*f*, and curvilinear sidewall 35*f* are integrally formed at the time of manufacture. The recess wall includes a smooth curvilinear sidewall portion 40*f* intersecting the planar bottom surface 42*f* at a right angle at point 33*f*.

A preferred method of forming the recesses 34, 34*b*–34*e* and 134, 134*a* from the front of the substrate using a router tool is contained in our co-pending patent application Ser. No. 09/655,650 of which this application is a continuation-in-part.

Figure 9A:
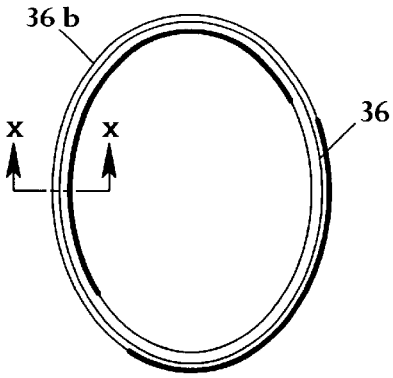

FIGS. 9*a* through 9*h* illustrate a variety of retaining rings which may be used in the present invention. The preferred retaining rings are made of flexible plastic and may have any of the typical cross sections illustrated in FIGS. 10*a* through 10*j*. The retaining ring 36 of FIG. 9*a*, having a cross section taken through lines X—X and illustrated in FIG. 10*a*, may be taken as exemplary of common characteristics described as follows. Retaining ring 36 has a flat underside 36*a*, which contacts and retains the protective cover of the photograph, and a sidewall 36*b*, which contacts and engages the smooth sidewall portion of the recess walls. Referring to FIG. 9*a* of the drawing, retaining ring 36 has a first curvilinear peripheral outline defined by the wall 36*b*. Ring 36 has an outer peripheral dimension selected to allow continuous engagement of the ring with the peripheral dimensions of the recess, and a third or inner peripheral dimension, which is smaller than that of the object held in place.

Figure 9B:
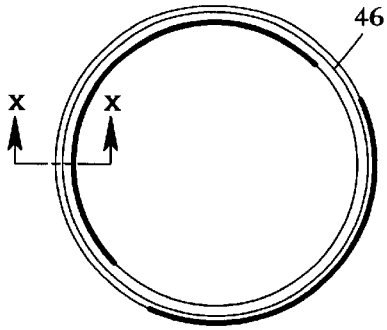
Figure 9C:
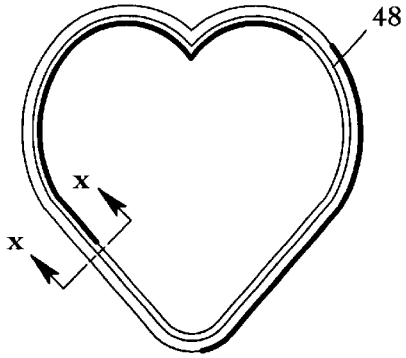
Figure 9D:
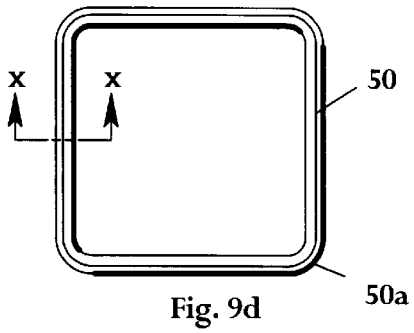
Figure 9E:
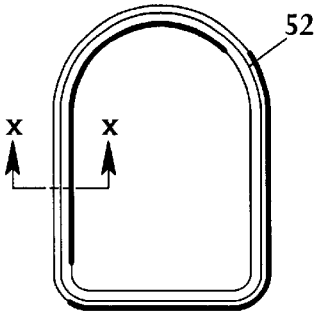
Figure 9F:
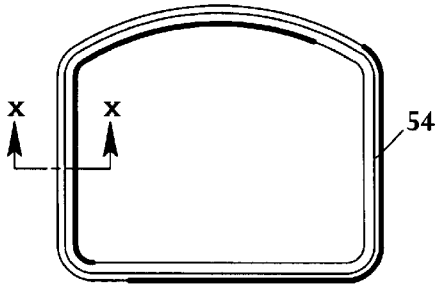
Figure 9G:
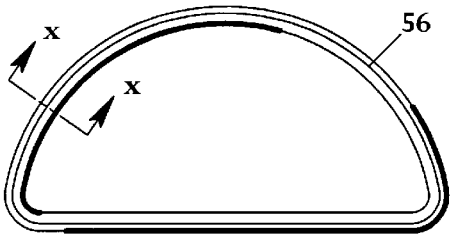
Figure 9H:
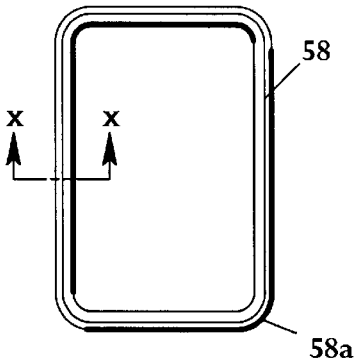

A variety of other retaining rings are shown. FIG. 9*b* shows a circular retaining ring 46. FIG. 9*c* shows a heart-shaped retaining ring 48. FIG. 9*d* is a square retaining ring 50 with filleted comers 50*a*. FIG. 9*e* shows retaining ring 52 with three straight sides and an arched top side for vertically-oriented photographs, while FIG. 9*f* illustrates retaining ring 54 of similar configuration, but dimensioned for landscaped views. FIG. 9*g* shows a semi-circular ring 56 with filleted inside comers. FIG. 9*h* depicts a retaining ring 58 having straight sides and filleted comers 58*a*. Other shapes are possible to create selected mountings, such as polygons (not illustrated) with any number of straight sides and provided with filleted comers at the intersections of the straight sides so as to fall within the scope of the definition of "curvilinear" retaining rings and recesses.

A variety of retaining ring cross sections 110 through 113 are illustrated in FIGS. 10*b* through 10*e* respectively, which provide decorative exposed surfaces 110*a* through 113*a* in recesses where the sidewall portion intersects the bottom planar surface at an acute angle.

FIG. 10*f* illustrates a second type of retaining ring 136 with a flat underside 136*a* that contacts and retains the thin protective cover. A sidewall 136*b* contacts and engages the smooth sidewall portion of the recess. Surfaces 136*a* and 136*b* meet substantially at a right angle. Those same decorative exposed surfaces 110*a* through 113*a* are shown in FIGS. 10*g* through 10*j* as decorative exposed surfaces 114*a* through 117*a* respectively, being applied to retaining rings with sidewalls arranged to fit recesses where the recess sidewall intersects the planar bottom surface at a right angle, similar to FIG. 10*f*.

Referring to FIGS. 11, 12 and 13 of the drawing, a modified form of the invention is illustrated. FIG. 11 shows a retaining ring 70 of flexible molded plastic having a bottom surface 70*a* arranged to contact the protective cover, a sidewall 70*b* dimensioned to frictionally engage the recess sidewall and having a smaller inner peripheral dimension for holding an object in place which is inserted from the front of the substrate into the recess. Ring 70 is provided with an overhanging flange 70*c*. Referring to FIG. 13 of the drawing, the arrangement is identical to that shown in FIG. 5, except that retaining ring 70 is substituted for retaining ring 136. The overhanging lip or flange 70*c* provides an enhanced decorative rim hiding the edge of the recess, so as to render invisible any chipping or damage to the edge of the recess created in the process of forming it.

FIG. 12 of the drawing shows an alternate cross section for a retaining ring with a flange. A retaining ring 72 includes a peripheral web 72*a* supporting an overhanging lip 72*b*. Web 72*a* increases the ability of retaining ring 72 to maintain frictional engagement with the sidewall of the recess.

FIG. 14 illustrates the cross section of a retaining ring 74 with a composite construction comprising a core 74*a* of spring metal, over-molded with a flexible plastic exterior 74*b* in a shape previously described.

FIG. 16 illustrates the retaining ring 74 frictionally engaging the sidewall of the recess 140 and holding the protective cover 138 and photograph 132 in the recess.

FIG. 15 illustrates a retaining ring 80 with a spring metal core 80*a* covered with plastic tubing 80*b*.

Other modifications of the invention are shown in FIGS. 17 through FIG. 20. In the embodiment of the invention where the recess sidewall is perpendicular to the planar bottom surface, frictional engagement with the sidewall is the preferred method of holding the retaining ring in the recess. Since the peripheral dimension of the recess and the peripheral dimension of the retaining ring are substantially the same when the ring is installed in the recess, a preferred method to create this frictional engagement is to manufacture the retaining ring so that its unconfined peripheral outline is slightly different than the peripheral outline of the recess, even though its peripheral dimension is the same. Therefore, when the retaining ring is flexed to insert it, it tends to try to assume its unconfined shape and to press diametrically against the sidewalls of the recess. This is illustrated in FIG. 17 of the drawing. Retaining ring 36 is shown in its unconfined shape prior to insertion in the recess 34. Both ring 36 and recess 34 have the same peripheral dimension. However, they have different elliptical shapes, since the major axis of elliptical retaining ring 36 is greater than the major axis of elliptical recess 34, and conversely the minor axis of retaining ring 36 is smaller than the minor axis of elliptical recess 34. When retaining ring 36 is inserted, it will try to assume its unconfined state and exert pressure on the sidewalls at points 82, 84.

An alternate means to obtain frictional engagement with the recess sidewall is shown in FIG. 18. A retaining ring 86 is shown in bottom plan view to be provided with longitudinal slits 88. Spring metal inserts 89 having a curvature different than that of the recess curvature are inserted into slits 88. This causes retaining ring 86 to exert pressure diametrically on the recess sidewall to increase frictional engagement.

Similarly, in FIG. 20 retaining ring 90 in bottom plan view is shown to be provided with integrally molded spring metal inserts 92 and insert pockets 94. These inserts are arranged so as to require bending or flexing in order to be disposed in the recess. When retaining ring 90 is inserted, these inserts will try to assume their unconfined state and exert frictional pressure on the sidewalls.

In FIG. 19, yet another way of creating frictional engagement of the retaining ring with the sidewall is shown. Retaining ring 96, shown in bottom plan view, is provided with integral flexible tabs 98 which extend radially beyond the perimeter of the ring in its unconfined state. To be inserted in the recess, these tabs must be flexed inward, and try to assume their unconfined positions once installed in the recess, thereby creating frictional pressure along the sidewall where they contact it.

The invention is especially adaptable to creating single or multiple photograph mountings in substrates having free-form perimeters. FIGS. 21*a* through 21*c* illustrate a variety of display frames created in this manner. FIG. 21*a* shows a substrate 100 with multiple elliptical recesses 101, into which elliptical retaining rings 102 have been installed, and multiple circular recesses 103, into which circular retaining rings 104 have been installed.

Similarly, FIG. 21*b* shows a substrate 105 with a different free-form perimeter, into which polygonal recesses 106 with filleted comers have been formed. Polygonal retaining rings 107 with filleted comers 108 are shown installed.

FIG. 21*c* illustrates a substrate 109 with an even more intricate perimeter, into which an elliptical recess 110 has been formed. An elliptical retaining ring 111 has been installed to retain the thin flat object as before.

It can be seen by these examples that there are many ways to configure flexible, continuous, curvilinear retaining rings so they may be disposed in recesses having sidewalls that intersect a planar bottom surface either perpendicularly or at an acute angle, and whereby the retaining rings are retained in the recess by friction or interference with a smooth curvilinear sidewall.

While there has been described what is considered to be the preferred embodiment of the invention and several modifications, it is desired to secure in the appended claims all such modifications as fall within the true spirit and scope of the invention.

What is claimed is:

1. A system for mounting thin flat items, comprising:

a substrate comprising a single unitary member having an outer surface defining at least one recess therein, said recess having an opening thereinto from said outer surface, a closed, planar bottom surface, and a curvilinear recess wall connecting said closed planar bottom surface to said recess opening in said outer surface, said recess wall having a smooth curvilinear sidewall portion intersecting said planar bottom surface, said recess wall defining a continuous curvilinear periphery of said recess having a first peripheral outline, a first peripheral dimension and a second peripheral dimension, whereby the first peripheral outline and first peripheral dimension define the smallest shape and size, respectively, of the recess, and whereby the first peripheral outline and the second peripheral dimension define the shape and size, respectively, of said recess at the intersection of said sidewall portion and said planar bottom surface;

a continuous flexible decorative retaining ring, said retaining ring having a curvilinear peripheral outline corresponding to said first peripheral outline arranged to contact said sidewall portion, said retaining ring being disposed in the recess, said retaining ring having a third peripheral dimension smaller than the first peripheral dimension, so as to retain a said thin flat item that has been inserted into the recess opening; and wherein the second peripheral dimension of the recess is greater than the first peripheral dimension of the recess, whereby said retaining ring is held in place by interference engagement with said sidewall portion of the recess.

2. The system according to claim 1, wherein said retaining ring further includes a peripheral flange, said flange extending radially outward beyond the recess opening to overlie a portion of said outer surface.

3. The system according to claim 1, wherein said flexible retaining ring defines at least one longitudinal slit, and having a spring metal insert disposed in said slit.

4. The system according to claim 1, wherein said flexible retaining ring has at least one integral spring metal insert protruding from its perimeter.

5. The system according to claim 1, wherein said flexible retaining ring comprises a flexible metal core disposed within a flexible plastic exterior.

6. The system according to claim 1, wherein said flexible retaining ring has a second peripheral outline when not confined in the recess, said second peripheral outline being different from the first peripheral outline so as to require flexing the retaining ring to insert it into the recess.

7. The system according to claim 1, wherein said recess includes an upper decorative wall portion connecting said sidewall portion to the opening in said substrate outer surface.

8. A system for mounting thin flat items, comprising:

a substrate comprising a single unitary member having an outer surface defining at least one recess therein, said recess having an opening thereinto from said outer surface, a closed, planar bottom surface, and a curvilinear recess wall connecting said planar bottom surface to said recess opining in said outer surface, said recess wall having a smooth curvilinear sidewall portion intersecting said planar bottom surface, said recess wall defining a continuous curvilinear periphery of said recess having a first peripheral outline, a first peripheral dimension and a second peripheral dimension, whereby the first peripheral outline and first peripheral dimension being the smallest shape and side, respectively, of the recess, and whereby the first peripheral outline and the second peripheral dimension represent the shape and size, respectively, of said recess at the intersection of said sidewall portion and said planar bottom surface;

a transparent protective cover, said cover being disposed in the recess so as to rest on top of the this, flat item and to hold the item against the planar bottom surface of the recess, said cover having a curvilinear peripheral outline corresponding to the first peripheral outline of said recess but having a slightly smaller peripheral dimension than the first peripheral dimension of said recess, whereby said cover is arranged to fit inside said recess;

a continuous flexible decorative retaining ring, said retaining ring having a curvilinear peripheral outline corresponding to said first peripheral outline arranged to contact said sidewall portion, said retaining ring being disposed in the recess and having a third peripheral dimension smaller than the first peripheral dimension, so as to retain said transparent protective cover in the recess; and wherein the second peripheral dimension of the recess is greater than the first peripheral dimension of the recess, whereby said retaining ring holds said protective cover in place by interference engagement with said sidewall portion of the recess.

* * * * *